United States Patent [19]

Stahre

[11] Patent Number: 4,849,612

[45] Date of Patent: Jul. 18, 1989

[54] APPARATUS FOR PERMITTING VIEWING OF A LARGE NUMBER OF ENTRIES PRINTED ON A SHEET LEAVING A CALCULATING MACHINE

[76] Inventor: Helge Stahre, Langsjövägen, S-131 00 Nacka, Sweden

[21] Appl. No.: 100,782

[22] PCT Filed: Jan. 9, 1987

[86] PCT No.: PCT/SE87/00008

§ 371 Date: Sep. 14, 1987

§ 102(e) Date: Sep. 14, 1987

[87] PCT Pub. No.: WO87/04120

PCT Pub. Date: Jul. 16, 1987

[30] Foreign Application Priority Data

Jan. 14, 1986 [SE] Sweden ..... 8600146

[51] Int. Cl.[4] ..... G06C 5/02

[52] U.S. Cl. ..... 235/58 CF; 235/1 D; 235/60.51; 400/718

[58] Field of Search ..... 235/6 R, 7 R, 58 R, 235/58 CW, 58 CF, 60.41, 60.42, 60.51, 1 D; 400/717, 718, 718.1

[56] References Cited

U.S. PATENT DOCUMENTS

| | | | |
|---|---|---|---|
| 339,497 | 4/1886 | Thomas | 400/718 X |
| 2,574,575 | 11/1951 | MacIntyre | 400/718 |
| 3,333,671 | 8/1967 | Rohde | 400/619 |
| 3,762,529 | 10/1973 | Griffith | 400/718 X |
| 3,767,024 | 10/1973 | Banwarth | 400/619 |

FOREIGN PATENT DOCUMENTS 154359 5/1956 Sweden .

OTHER PUBLICATIONS

IBM Technical Disclosure Bulletin, vol. 25, No. 38, Aug. 1982, pp. 1627–1628.

*Primary Examiner*—B. R. Fuller

*Attorney, Agent, or Firm*—Oblon, Spivak, McClelland, Maier, & Neustadt

[57] ABSTRACT

An apparatus for permitting the viewing of a large number of entries permitted on a sheet leaving a calculating machine includes an elongate bar having a longitudinal track, a support plate having a lower end fitted in the track and an elongate fastening device connected to the elongate bar and extending transverse to the length of elongate bar. The track supports the support plate fitted therein at an angle of between 35 and 70 degrees with respect to the horizontal and has a length greater than a width of the support plate so that the position of the support plate along the track may be adjusted. The support plate includes flanges for laterally guiding longitudinal edges of the sheet supported therein. The elongate bar may be secured to the calculating machine by the fastening device at a position where the sheet leaving the calculating machine may be supported and guided by the guide plate fitted in the elongate bar.

9 Claims, 7 Drawing Sheets

APPARATUS FOR PERMITTING VIEWING OF A LARGE NUMBER OF ENTRIES PRINTED ON A SHEET LEAVING A CALCULATING MACHINE

BACKGROUND OF THE INVENTION

1. Field of the Invention:

The present invention relates to an apparatus for permitting the viewing of a large number of entries printed on a sheet leaving a calculating machine, such as a sheet unrolled from a paper roll attached to the calculating machine. In particular, the present invention relates to a supporting plate which is attached to the upper side of a calculator and which rests on the horizontal top surface of the calculator to support the paper coming out from the calculator, the supporting plate being laterally adjustable.

2. Description of the Related Art:

In a conventional calculator, the paper leaves the printing part of the calculator and passes a small plate in order to prevent the paper from again being caught in the calculator together with the paper entering the calculator from the paper roll. Since the paper tends to curl up once it is discharged from the calculator, one can see very few entries printed on the paper strip as it rolls up behind the calculator. As the number of printed entries increase, they cannot readily be seen or annotated, as by underlining. Therefore, a review of the entries is time consuming and difficult unless the paper is cut into sections. However, cutting the paper into sections makes impossible a continuous presentation of the entries at a later time. This is a particular problem in certain professions, such as accounting, auditing, economics and banking where a large number of entries are calculated at a time.

SUMMARY OF THE INVENTION

It is an object of the present invention to eliminate the above-mentioned disadvantages. For this purpose, the present invention provides an apparatus for permitting the viewing of a large number of entries printed on a sheet leaving a calculating machine, which apparatus comprises an elongate bar having a longitudinal track, a support plate having a lower end fittable in the track and an elongate fastening means connected to the elongate bar and extending transverse to the length of the elongate bar. The track has means for supporting the support plate fitted in the track at an angle of between 35 and 70 degrees with respect to the horizontal. The track has a length greater than a width of the support plate so that the position of the support plate along the track may be adjusted. The support plate includes means for laterally guiding longitudinal edges of a sheet supported therein. The elongate fastening means includes means for securement to a calculating machine. The elongate bay may be secured to the calculating machine by the fastening means at a position where a sheet leaving the calculating machine may be supported and guided by the guide plate fitted in the elongate bar.

The above construction provides advantages including more rapid observations since one need not manipulate the coiled up discharged paper in order to see the various entries. Since a large number of entries are immediately visible to the observer, it is easier to understand the progression of numbers in the various entries. The paper sheet can be cut at a desired point without regard to how much can be seen at a time, and one need not glue together different parts of the sheet which were cut only to permit easy observation.

According to a feature of the invention, a device for securing accessories, such as a pencil or eraser, can be attached to the back of the support plate.

According to another feature of the invention, a transparent plate having optical magnifying means can be fitted to the support plate for magnifying the size of entries printed on the sheet supported and guided in the support plate. This is particularly advantageous for calculators which produce small printing.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

Figure 1:
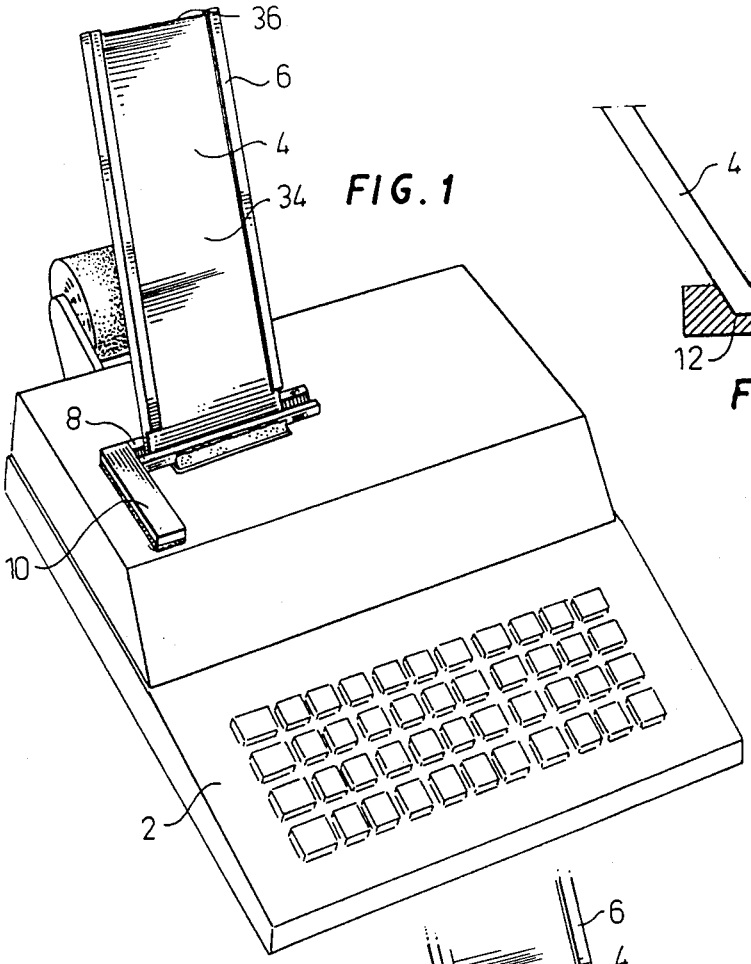
FIG. 1 is a front, side and top respective view of a calculator having an apparatus according to the invention mentioned thereon.
Figure 14:
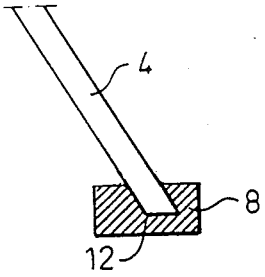
FIG. 14 is a sectional detail view showing the mounting of the support plate to the elongate bar.

Referring to FIG. 1, the apparatus of the invention is there shown as mounted on a calculator 2. The elongate bar 8 rests on an upper surface of the calculator and has a track 12. The support plate 4 has a lower end fitted in the track 12 and is supported by the track 12 at an angle of approximately 60 degrees with respect to the horizontal, as shown in FIG. 14.

The supporting plate is formed of a transparent plastic material and has at each side a flange 6 for holding and guiding paper supported on the support plate. A transparent sheet 34 can fit over the support plate so that the paper discharged from the calculator is positioned between the support plate and the transparent plate. The transparent plate can have a convex configuration so as to magnify the entries on the sheet supported by the support plate.

Figure 3:
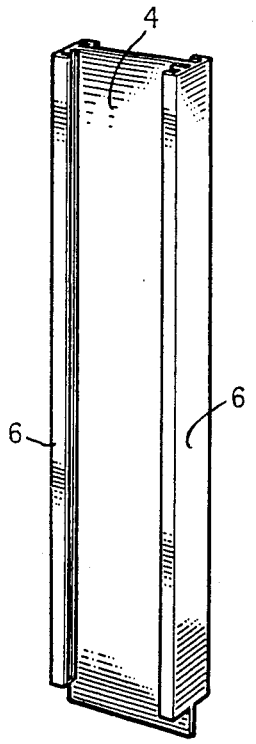
FIG. 3 is a perspective view of the support plate.
Figure 4:
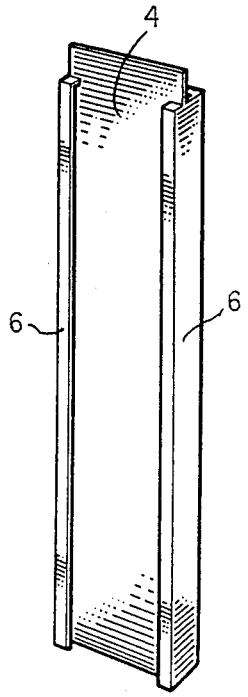
FIG. 4 corresponds to FIG. 3, but shows the support plate turned upside down.
Figure 2:
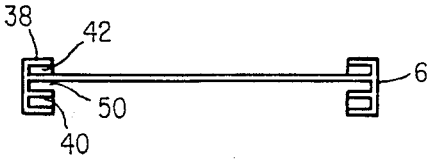
FIG. 2 is a top end view of a support plate according to the invention.

In the embodiment of FIGS. 2–4, the flanges 6 form both a guiding track 50 for guiding the sheet and a track 40 for the transparent plate 34, as well as a track 42 with gripping edges 38 for accessories, such as an information leaf, mirror, etc.

Figure 6:
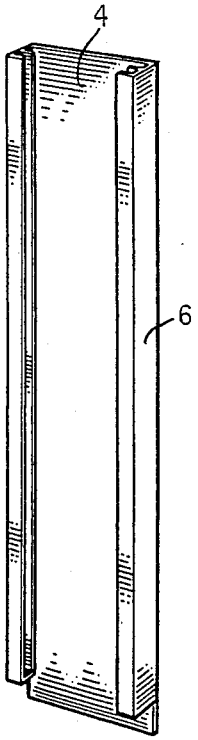
FIG. 6 corresponds to FIG. 3 but shows the second embodiment of the invention.
Figure 5:
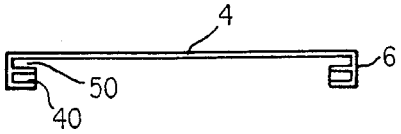
FIG. 5 corresponds to FIG. 2 but shows a second embodiment of the invention.
Figure 7:
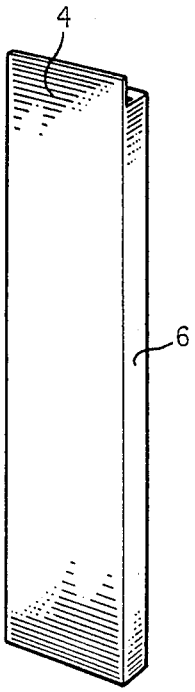
FIG. 7 corresponds to FIG. 4 but shows the second embodiment of the invention.

In the embodiment of FIGS. 5–7, the track 42 is eliminated.

Figure 9:
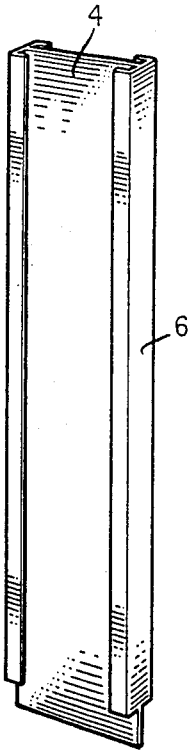
FIG. 9 corresponds to FIG. 3 but shows the third embodiment of the invention.
Figure 8:
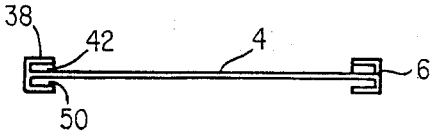
FIG. 8 corresponds to FIG. 2 but shows a third embodiment of the invention.
Figure 10:
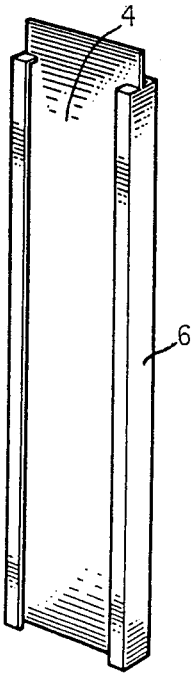
FIG. 10 corresponds to FIG. 4 but shows the third embodiment of the invention.

The embodiment of FIGS. 8–10 is similar to that of FIGS. 5–7, except that the tracks 40 and 50 are on opposite sides of the support plate 4.

Figure 12:
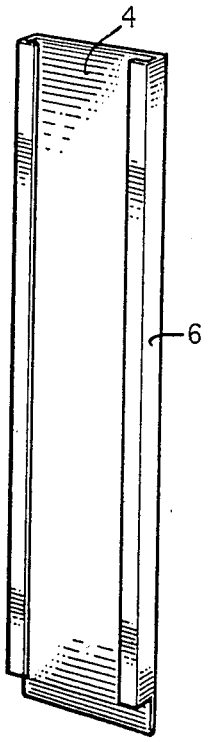
FIG. 12 corresponds to FIG. 3 but shows the fourth embodiment of the invention.
Figure 11:
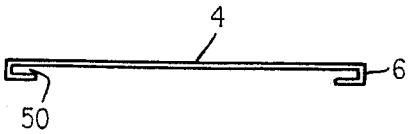
FIG. 11 corresponds to FIG. 2 but shows a fourth embodiment of the invention.
Figure 13:
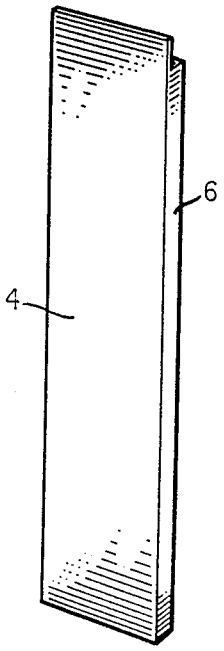
FIG. 13 corresponds to FIG. 4 but shows the fourth embodiment of the invention.

In the embodiment of FIGS. 11–13, only a single track 50 is provided.

The elongate bar 8 can be placed on the machine just behind the discharge opening for paper having entries printed thereon, so that the paper can be guided within the support plate 4. This is seen in FIG. 1. In the embodiment of FIG. 1, an elongate fastening means is provided in the form of a bar 10 which is attached to the end of the elongate bar 8. The bar 10 extends transverse to the length of the bar 8 and is attached to the calculator 2, for example, by gluing. The bar 10 extends in a direction opposite to the angle at which the support plate 4 leans, and so can support the torque arising from the weight of the support plate and the paper guided therein. The length of the bar 10 should be long enough to provide a torque arm sufficient for this purpose.

Since the length of the track 12 is greater than the width of the support plate 4, the position of the support plate can be properly adjusted relative to the paper simply by lifting and repositioning the support plate within the track 12. The 60 degree angle of the thus supported support plate with respect to the horizontal is considered to be optimal from a viewing standpoint.

Figure 15:
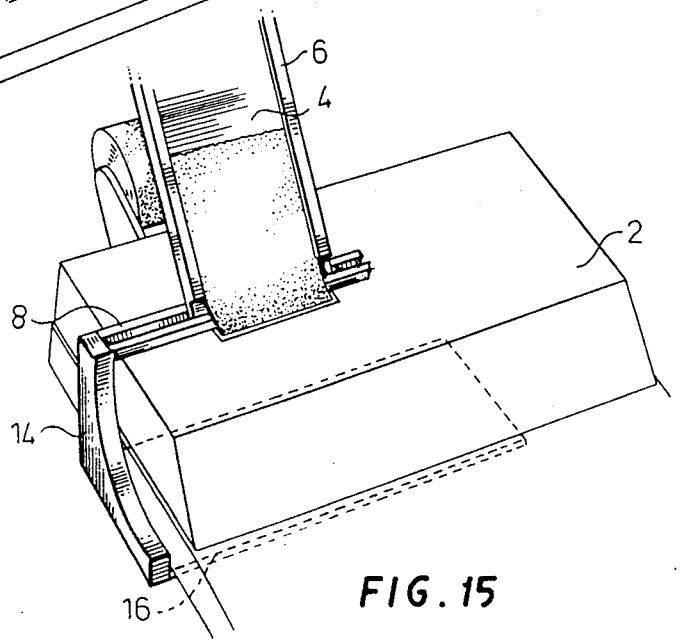
FIG. 15 corresponds to FIG. 1 but shows yet a further embodiment of the invention.

In the alternate embodiment of FIG. 15, the bar 10 is replaced by a side piece 14 which extends downwardly and to which is attached a second supporting plate 16 which can be held under the calculator 2 in order to fix the position of the elongate bar 8 at the top of the calculator 2. The end of the elongate bar can slide in a vertical track (not shown) in the side piece 14 for adjusting the spacing between the bars 8 and 16 to correspond with the height of different calculator designs. The apparatus according to this embodiment can thus be easily transferred from one calculator to another.

Figure 16:
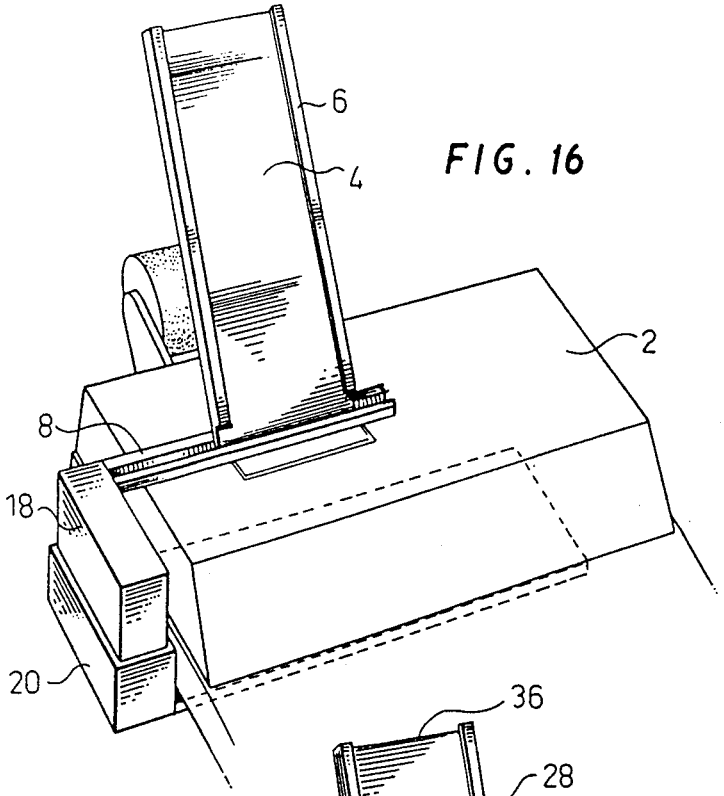
FIG. 16 corresponds to FIG. 1 but shows yet a further embodiment of the invention.

In the embodiment of FIG. 16, the side piece is formed of two parts, an outer down part 20 and an inner down part 18 which fits within the outer part 20 in a tight gripping manner. By sliding the down part 18 in the down part 20, one can adjust the spacing between the bars 8 and 16 to accommodate the heights of various calculator designs, as is the case in FIG. 15.

Figure 17:
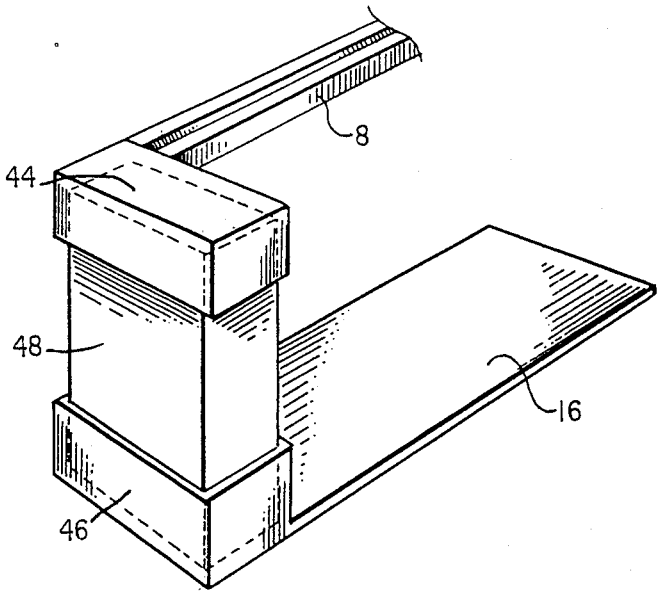
FIG. 17 is a perspective detail of yet a further embodiment of the invention.

The embodiment of FIG. 17 differs from that of FIG. 16 in that the side piece is formed of a pair of boxes 44 and 46 which are connected by a piece 48 fitted therein. One can vary the spacing between the bars 8 and 16 to accommodate different calculator heights by using pieces 48 of different lengths.

Figure 18:
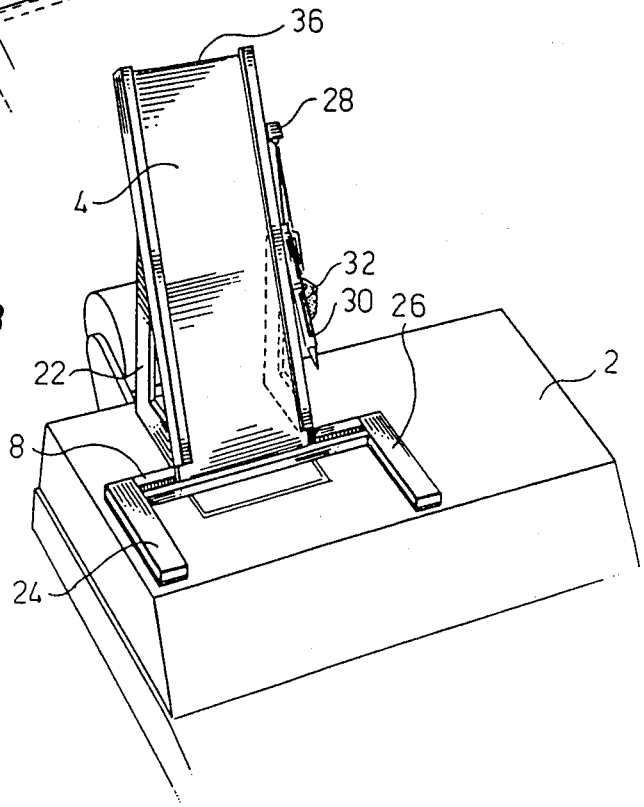
FIG. 18 corresponds to FIG. 1 but shows yet a further embodiment of the invention.

In the embodiment of FIG. 18, an angled supporting construction 22 is attached to the back side of the supporting plate 4 and include a horizontal part which rests against the upper surface of the calculator to help support the support plate when the support plate is fitted in the groove 12, to thereby give the support plate 4 greater stability. This is particularly important with long support plates. In this embodiment, there are also two of the fastening means 24 and 26 which correspond to the fastening means 10 of FIG. 1.

Holding equipment in the form of a fastener 28 can be used to attach accessories such as a pencil 30 or an eraser 32 to the support plate and make more convenient the marking or annotating of the entries on the sheet.

The top edge of the support plate can be formed as a cutting edge 36.

The bottoms of the guides 40 and 42 should form stops for the transparent plate 34 or accessories held therein.

Obviously, numerous modifications and variations of the present invention are possible in light of the above teachings. It is therefore to be understood that within the scope of the appended claims, the invention may be practiced otherwise than as specifically described herein.

What is new and desired to be secured by Letters Patent of the United States is:

1. An apparatus for permitting viewing of a large number of entries printed on a sheet leaving a calculating machine, comprising:

an elongate bar having a longitudinal track and positionable on an upper surface of the calculating machine;

a support plate having a lower end fittable in said track, said track having means for supporting said support plate fitted in said track at an angle of between 35 and 70 degrees with respect to a horizontal plane, said track having a length greater than a width of said support plate so that a position of said support plate along said track may be adjusted, said support plate further includes means for laterally guiding longitudinal edges of a sheet supported therein; and an elongate fastening means connected to said elongate bar and extending transverse to a length of said elongate bar for securing said elongate bar to the calculating machine, said fastening means including means for attachment to the upper surface of the calculating machine, whereby said support plate is supported by the attachment of the fastening means to said calculating machine at a position spaced from said elongate bar in the direction transverse to the length of said elongate bar, whereby said elongate bar may be secured to the calculating machine by said fastening means at a position wherein a sheet leaving the calculating machine may be supported and support by the guide plate fitted in said elongate bar.

2. The apparatus of claim 1 wherein a length of said support plate exceeds 8 cm.

3. The apparatus of claim 1 wherein a length of said support plate exceeds 30 cm.

4. The apparatus of claims 1 or 3 wherein said angle is 60 degrees.

5. The apparatus of claim 1 wherein said support plate includes an angled support element having a horizontal portion which rests on the calculating machine when said support plate is fitted in the elongate bar secured to the calculating machine.

6. The apparatus of claim 1 including a transparent plate having magnifying means and positioned on said support plate such that a sheet supported on said support plate is magnified.

7. The apparatus of claim 1 including sheet cutting means at a top edge of said support plate.

8. The apparatus of claim 1 wherein said support plate is transparent, including means attached to said support plate for holding accessories.

9. The apparatus of claim 1 wherein said means for securement comprises an adhesive.

* * * * *